US005557287A

United States Patent [19]

Pottala et al.

[11] Patent Number: 5,557,287

[45] Date of Patent: Sep. 17, 1996

[54] SELF-LATCHING ANTENNA FIELD COUPLER

[75] Inventors: James V. Pottala, Ft. Lauderdale; Robert B. Ford, Tamarac, both of Fla.

[73] Assignee: Motorola, Inc., Schaumburg, Ill.

[21] Appl. No.: 399,271

[22] Filed: Mar. 6, 1995

[51] Int. Cl.[6] ..... H01Q 1/24; H01Q 1/50

[52] U.S. Cl. ..... 343/702; 343/703; 343/841

[58] Field of Search ..... 343/702, 703, 343/841, 872, 905, 906; 455/89, 90; H01Q 1/42, 1/50

[56] References Cited

U.S. PATENT DOCUMENTS

| | | | |
|---|---|---|---|
| D. 354,961 | 1/1995 | Richards et al. | D14/253 |
| 4,661,992 | 4/1987 | Garay et al. | 455/89 |
| 4,725,845 | 2/1988 | Phillips | 343/702 |
| 4,740,794 | 4/1988 | Phillips | 343/702 |
| 5,255,001 | 10/1993 | Tamura et al. | 343/702 |
| 5,281,970 | 1/1994 | Blaese | 343/702 |

*Primary Examiner*—Michael C. Wimer
*Attorney, Agent, or Firm*—Andrew S. Fuller

[57] ABSTRACT

A self-latching antenna field coupler (120) includes two housing members (210, 230). One of the housing members (230) is movable, relative to the other housing member (210), between a first position to define an antenna receiving channel (222), and a second position to define a secured antenna chamber (322). A latch actuator (250) is mechanically coupled to the movable housing member (230), to automatically effect movement of the movable housing member (230) from the first position to the second position when an antenna (195) is received in the antenna receiving channel (222).

19 Claims, 4 Drawing Sheets

SELF-LATCHING ANTENNA FIELD COUPLER

TECHNICAL FIELD

This invention relates in general to radio communication device and more particularly, to antenna coupling for a radio communication device.

BACKGROUND OF THE INVENTION

Radio communication devices, such as portable two-way radios, typically have attached antennas which are extended to provide effective radiation of wireless radio frequency (RF) signals. In many situations, it may be desirable to increase the effective communication range of a two-way radio by connecting it to an external antenna. For example, when operating the radio inside a vehicle, a separate external antenna may be connected via a vehicular adapter to facilitate communications.

A prior art method for connecting a separate external antenna to a radio includes the use of a coaxial or jack connector mounted to the radio. The connector provides a direct mechanical connection between the external antenna and the radio. Problems associated with mechanical connectors which carry radio frequency signals are well known. Issues pertaining to reliability and mechanical tolerances are typical in this area. Other prior art solutions employ the use of a connectorless RF antenna coupler. Generally, the radio is placed such that a radiating element for the radio's antenna system is adjacent to an RF pickup element which is coupled to the external antenna. Preferably, the radiating element of the radio is shielded to increase the coupling of radiated energy to the RF pickup element.

A vehicular adapter designed to accommodate a radio communication device while employing a connectorless RF antenna coupler is known. Ordinarily, the vehicular adapter is designed such that an operator may insert and remove the radio with relative ease. The radio must be properly positioned within the vehicular adapter, and the attached antenna positioned within or adjacent to the RF antenna coupler in order to permit the radio to operate through a connected external antenna. In a typical prior art design, the operator may have to perform a number of steps in order to secure the radio within the vehicular adapter and to position the radiating element with respect to the RF coupler. As such, there might be several steps required to enable proper coupling between the radio communication device and the external antenna.

It is desirable to provide a mechanism in which a radio communication device may be loaded into an adapter to enable an attached antenna to be passively coupled to an external antenna connected to the adapter. Preferably, the adapter is designed to minimize the number of steps required to load and unload the communication device while ensuring proper antenna coupling when the communication device is loaded. When the radio communication device is to be periodically placed into a vehicular adapter, the necessity for ease of operation increases. Prior art approaches are inadequate in accomplishing these goals. Therefore, a new approach to the design of an RF antenna coupler is needed.

DETAILED DESCRIPTION OF THE PREFERRED EMBODIMENT

Figure 1:
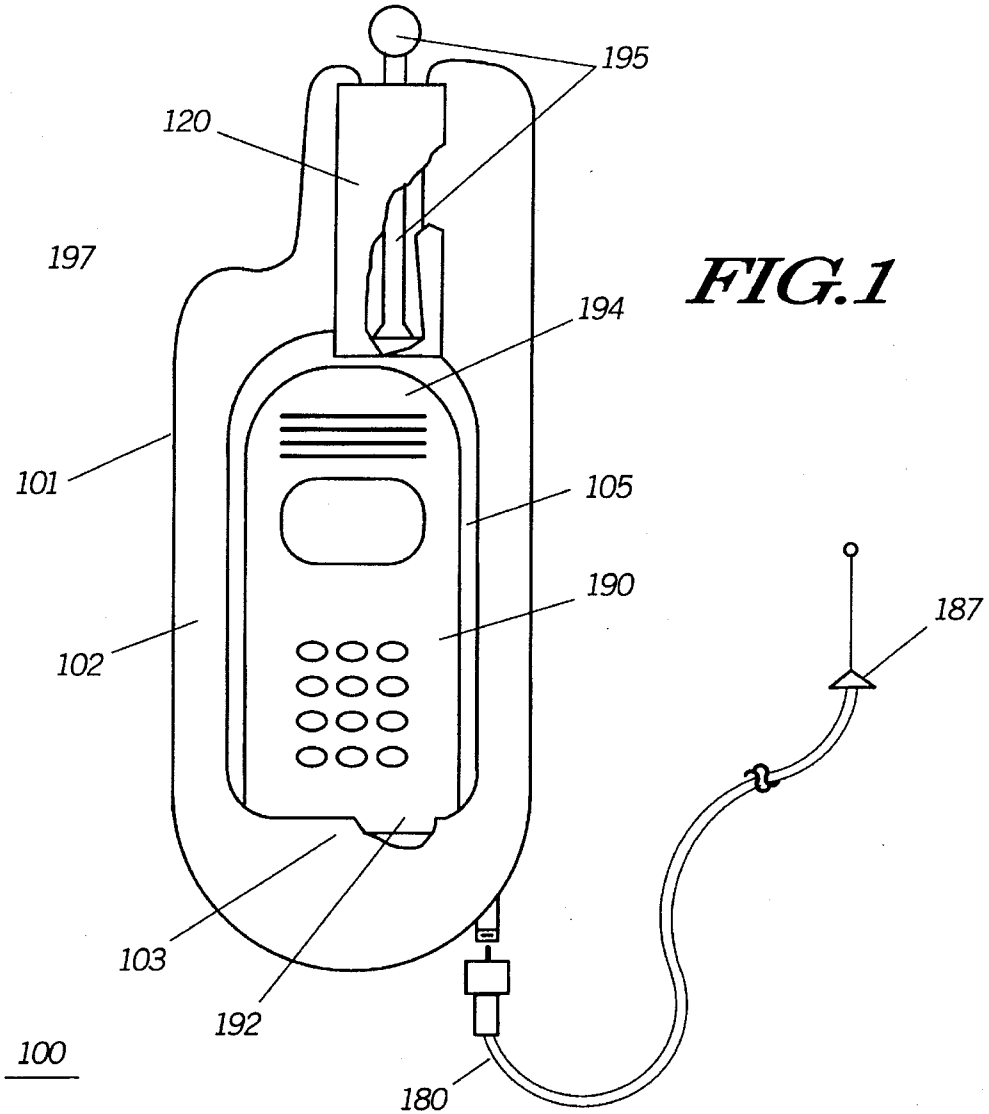
FIG. 1 is a plan view of a vehicular adapter with an integral antenna coupler, that has a two-way portable radio mounted therein, in accordance with the present invention.

While the specification concludes with claims defining the features of the invention that are regarded as novel, it is believed that the invention will be better understood from a consideration of the following description in conjunction with the drawing figures, in which like reference numerals are carried forward.

Generally, the present invention provides for a self-latching antenna field coupler, to couple wireless radio frequency signals to/from an antenna. The antenna field coupler includes two housing members. One of the housing members is movable, relative to the other, between an open position which defines an antenna receiving channel, and a closed position which defines an antenna chamber. A latch actuator, mechanically coupled to the movable housing member, is automatically engaged when an antenna is received in the antenna receiving channel and thereby moves the movable housing member to a closed position to form the antenna chamber.

Referring to FIG. 1, a plan view of an assembly 100 of a vehicular adapter 101 with a radio communication device 190 located therein is shown, in accordance with the present invention. The vehicular adapter 101 has a housing 102 with a radio cavity or pocket 105 formed therein to receive at least a portion of the portable radio communication device 190. The vehicular adapter housing 102 can be formed from plastic or other suitable materials. The vehicular adapter 101 may contain electrical circuitry and interfaces needed to interact with the portable radio communication device 190 as is well known in the art. The vehicular adapter 101 further includes a self-latching antenna field coupler 120, commonly referred to as a radio frequency (RF) coupler, to passively couple radiating wireless radio frequency signals which emanate from an internal antenna 195 attached to the radio communication device 190 via an antenna boss 197. The captured RF signals are routed from the antenna coupler 120, via a coaxial cable 180, or other transmission line, to an external antenna 187 which would be typically mounted external to a vehicle. Similarly, communication signals detected at the external antenna 187 are transferred to the attached internal antenna 195 of the radio 190 through the antenna coupler 120.

The antenna coupler 120 is formed as part of, or integrally with, the vehicular adapter 101. The antenna coupler 120 is situated to couple the attached antenna 195 of the radio 190 when located within the pocket 105. In the preferred embodiment, the antenna coupler 120 is designed to work in conjunction with the form factor of the vehicular adapter housing 102 to anchor the radio 190 within the pocket 105. Accordingly, the vehicular adapter housing 102 has a overhang 103 bordering the pocket to partially secure a bottom portion 192 of the radio 190. The antenna coupler 120 is formed to automatically latch or secure the attached antenna and/or other portion of the radio 190, when the radio 190 is inserted in the housing pocket 105. Preferably, the bottom portion 192 of the radio 190 is first inserted into the pocket beneath the overhang 103, and then the top portion 194 of the radio 190 rotated toward the antenna coupler 120. The automatic latching occurs when the attached antenna 195 or another portion of the radio 190, such as the antenna boss 197, engages the antenna coupler 120. As described below, the antenna coupler 120 is operable between an open position for receiving the antenna 195 and a closed position for the securing the antenna 195 and radio 190. The construction of the antenna field coupler 120 is a significant aspect of the present invention.

Figure 2:
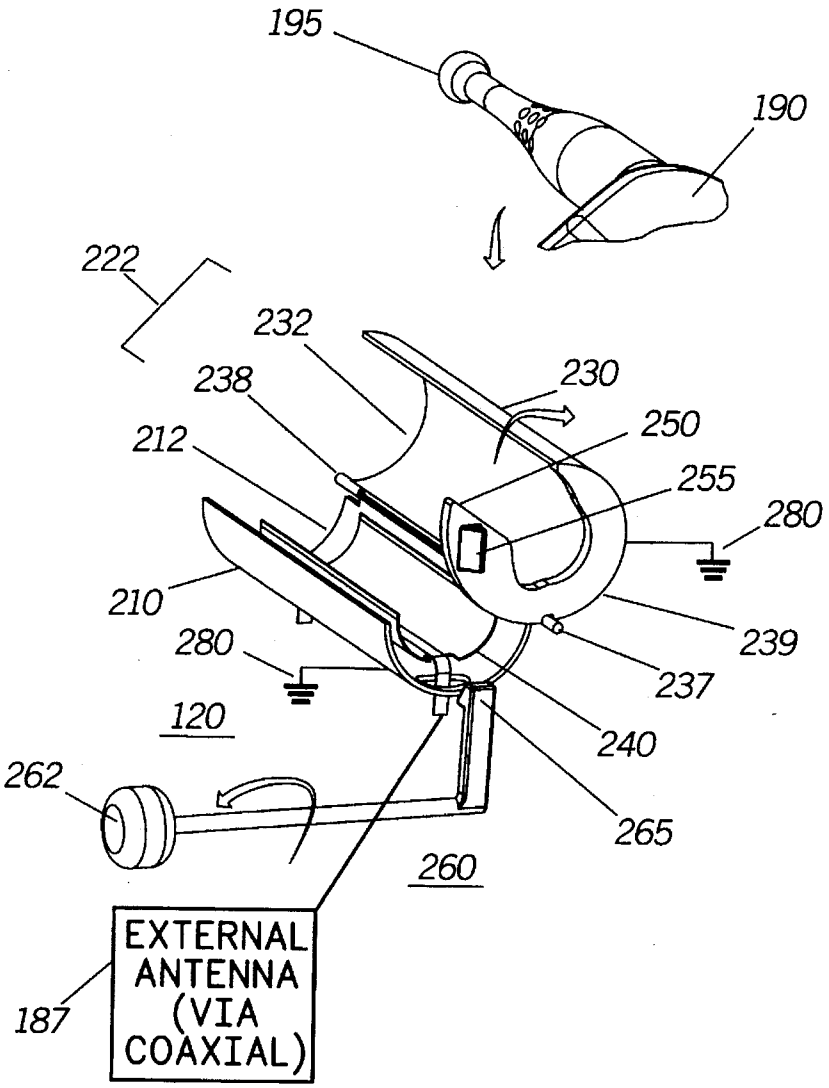
FIG. 2 is an isometric view of a first embodiment of an antenna coupler shown in an open position with an attached antenna of a radio being inserted therein, in accordance with the present invention.
Figure 3:
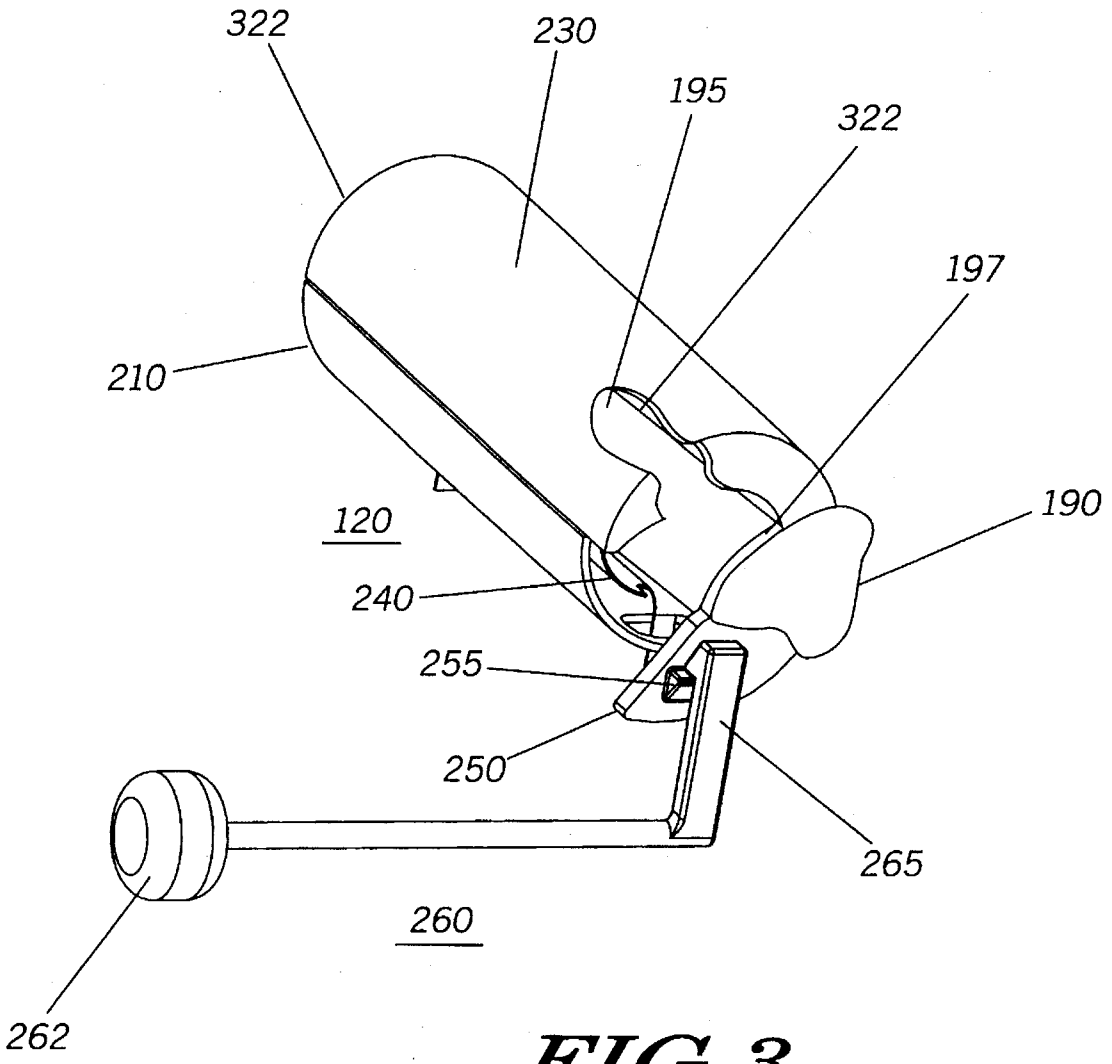
FIG. 3 is an isometric view of the antenna coupler of FIG. 2 shown in a closed position, in accordance with the present invention.

FIG. 2 shows the antenna coupler 120 in an open orientation with the antenna 195 about to be inserted, in accordance with the present invention. FIG. 3 shows the antenna coupler 120 in a closed orientation with the antenna 195 secured therein, in accordance with the present invention. Referring to FIG. 2 and FIG. 3, the antenna coupler 120 includes two housing members 210, 230. Each housing member 210, 230 is formed in part from an electrically conductive material which is coupled to electrical ground 280 to form an electrical ground plane and thus a radiation shield for the attached antenna 195. When coupled, the electrical length of the attached antenna 195 is effectively shortened, thereby causing radiation emitted from the attached antenna 195 to be substantially contained within the antenna coupler 120. The efficiency of the housing members 210, 230 as a radiation shield depends in part on the electrical conductivity of the conductive material used. In the preferred embodiment, the conductive material is formed from copper coated with zinc.

Each housing member 210, 230 has a substantially semicircular shape, or is otherwise shaped, to define a channel or cavity 212, 232 in the housing member to accommodate the antenna 195. The housing members 210, 230 are rotatably coupled together such that at least one of the housing members 230 is movable or pivotable relative to the other housing member 210. Preferably, the housing member 210 is fixed, and the other housing member 230 pivotable. The movable housing member 230 includes two bosses 237, 238 that act as pivot points. The movable housing member 230 can pivot between an open position (as shown in FIG. 2) and a closed position (as shown in FIG. 3). The movable housing member 230 pivots relative to the fixed housing member 210 such that when in an open position, the channels 212, 232 of the fixed and pivotable housing members 210, 230 are adjacent in an open clam-shell like configuration. The channels 212, 232 of both housing members 210, 230 together define an antenna receiving channel 222 when both housing members 210, 230 are in the open position. When in the closed position, the housing members 210, 230 form a secured antenna chamber 322 that accommodates and secures the antenna.

According to the present invention, a latch actuator 250 is mechanically coupled to the pivotable or movable housing member 230. In the preferred embodiment, the latch actuator 250 is formed from a part of the pivotable housing member 230, as a walled projection at one end 239 of the pivotable housing member 230. The actuator 250 is oriented to project within, or in line with, the antenna receiving channel 222 when the two housing members 210, 230 are in an open orientation. Additionally, the latch actuator 250 has a catch 255, in the form of a protrusion, formed thereon. The catch 255 is a part of a locking mechanism for the antenna coupler 120 that secures both housing members 210, 230 together when both are in a closed position.

When in the closed position the two housing members 210, 230, like two halves of a hollow cylinder, form a substantially enclosed secured antenna chamber 322, which extends three hundred and sixty degrees (360°) to substantially contain the radiation energy emanating from an antenna located therein. An antenna coupling element or pickup element 240 is positioned adjacent to, and within, the fixed housing member 210. Preferably, the antenna coupling element is shaped to accommodate the antenna. In the preferred embodiment, the antenna coupling element 240 has a semicircular shape extending longitudinally along the antenna coupler 120 when both housing members 210, 230 are in the closed position. Consequently, the antenna coupling element 240 is substantially concentric with the antenna 195, when the antenna 195 is inserted into the antenna receiving channel 222 and the housings closed to form the secured antenna chamber 322.

The latch actuator 250 effectuates the closing of the antenna coupler housing 230 when the antenna is inserted into the antenna receiving channel 222. Preferably, the pivotable housing member 230 is spring-loaded to an open position. When the antenna 195 is inserted into the antenna receiving channel 222, the antenna 195, or a portion of the radio 190, engages the latch actuator 250. This forces the latch actuator 250 and the attached pivotable housing member 230 to rotate to a closed position, thereby forming a cylindrical hollow 322 with the fixed housing member 210.

A release member 262, in the form of a button, with an integral locking portion 265, is biased to form a spring-loaded locking member 260. The spring-loaded locking member 260 is biased toward the latch actuator 250 and associated catch 255 when the antenna coupler 120 is open. When the antenna 195 is inserted into the antenna coupler 120, the latch actuator 250 rotates to a specific point that coincides with the closing of the antenna coupler 120. Simultaneously, the locking portion 265 engages the catch 255 and secures the pivotable housing member 230 with respect to the fixed housing member 210. In other words, the latch actuator 250 is engaged by the attached antenna 195 to automatically cause movement of the pivotable housing member 230 from the open position to the closed position when the attached antenna 195 is inserted or placed in the antenna receiving channel 222. When the pivotable housing member 230 closes, the attached antenna 195 is secured within a substantially enclosed antenna chamber 322, and the antenna 195 is positioned proximate to the antenna pickup element 240.

The antenna pickup element 240 is electrically coupled to a signal conductor (not shown) of the coaxial cable that leads to the external antenna 187 (see FIG. 1). The conductive material of the housing members 210, 230 is connected to electrical ground. The vehicular adapter 101 may contain an impedance matching network (not shown) to match the output impedance of the internal antenna 195 to the impedance of the external antenna 187. Note that when the antenna 195 is secured within the cylindrical hollow 322 formed by the two housing members 210, 230, a portion of the antenna may extend beyond the secured antenna chamber 322. However, by substantially enclosing a significant portion of the antenna by the electrical ground plane, most of the radiation from the internal antenna 195 is contained within the antenna coupler chamber 322. Further, the antenna pickup element 240 is electrically isolated from the other portions of the vehicular adapter 101 and antenna coupler 120, and connected via a coaxial path to the external antenna as a load.

The dimensions of the conductive material forming the ground plane of the first and second housing are chosen to match the dimensions and impedance of the radio 190 and antenna 195. For example, when a radio antenna is loaded into the coupler 120, the electrical ground plane causes the whip antenna to have a high source impedance near its base, rather than at the tip. The pickup element 240 is located near the high impedance region of the radio antenna and acts like a resonance circuit that efficiently couples the resultant electrical field from the antenna. Consequently, transmitted or received radio signals are coupled, via the pickup element 240, between the radio antenna and the external antenna.

Figure 4:
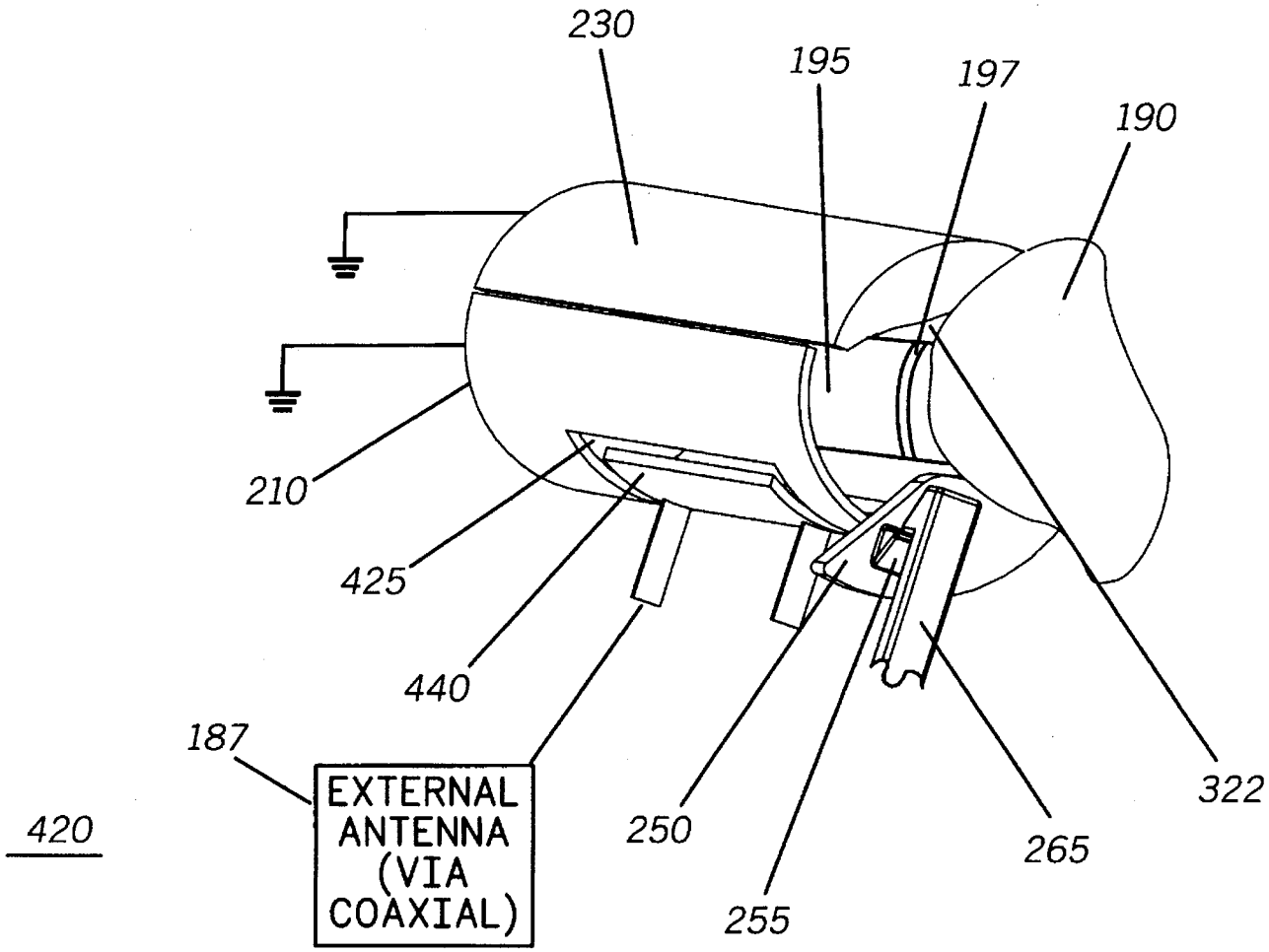
FIG. 4 is a second embodiment of the antenna coupler in which an antenna pickup element is positioned adjacent to the antenna coupler housing, in accordance with the present invention.

FIG. 4 is a second embodiment of the antenna coupler 420 in which the antenna pickup element 440 provides coupling through an access window 425 to the secured antenna chamber 322, via the fixed housing member 210. The antenna pickup element 440 may be positioned adjacent to, or through, the window 425 within the fixed housing member so as to be adjacent to the antenna 195 when the antenna 195 is loaded within the secured antenna chamber 322. Otherwise, the antenna coupler 420 is structurally and operationally similar to the antenna coupler 120 described earlier.

Referring to FIGS. 1, 2, and 3, the functional benefits of the present invention can be more fully appreciated. In operation a portable radio 190 is inserted into the pocket 105 of the vehicular adapter 101, and in the same motion the radio antenna 195 is positioned to engage the latch actuator 250 of the open antenna coupler 120. The force of the radio 190 being pressed against the pocket 105 of the vehicular adapter 101 also causes the antenna 195 to forcibly engage the latch actuator 250, which automatically pivots the pivotable housing member 230 such that it engages the fixed housing member 210 in a snap-shut configuration. Simultaneously, the spring loaded locking member 260 engages the catch 255 and secures the pivotable housing member 230 shut. To remove the radio 190 from the pocket 105 of the vehicular adapter 101, an operator pushes a release button 262 that disengages the locking member 260 from the catch 255, and because the pivotable member is spring loaded to an open position, the pivotable housing member 230 automatically snaps open. Thus, a simplified operation is provided to engage and disengage the radio 190 from the vehicular adapter 101 and antenna coupler 120.

The present invention provides significant benefits over the prior art. The antenna coupler 120, in a self-latching arrangement, mechanically couples the attached antenna 195 and/or a portion of the radio 190. In the same operation, the antenna coupler 120 electrically couples the attached antenna 195 via antenna pickup element 240 to an external antenna 187. An electrical ground plane, formed by the antenna coupler housing members 210, 230, substantially encloses the antenna, preferably by a 360° enclosure, to provide containment for RF signals emanating from the radio antenna 195. Consequently, interference to surrounding electronics is minimized. Moreover, an operator can accomplish this mechanical and electrical coupling in a one-step procedure which involves the mere insertion of a radio 190 within the pocket 105 of the adapter 101.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A self-latching antenna field coupler, comprising:

first and second mechanically coupled housing members, the first housing member being movable, relative to the second housing member, between a first position to define an antenna receiving channel, and a second position to form an antenna chamber defined by the first and second housing members; and a latch actuator positioned within the antenna receiving channel when the first housing member is in the first position, latch actuator automatically effecting movement of the first housing member from the first position to the second position when an antenna is received in the antenna receiving channel.

2. The self-latching antenna field coupler of claim 1, wherein the first and second housing members are coupled to electrical ground.

3. The self-latching antenna field coupler of claim 2, further comprising an antenna coupling element positioned adjacent to at least one of the first and second housing members.

4. The self-latching antenna field coupler of claim 3, wherein the antenna chamber has an access window and the antenna coupling element is positioned adjacent to the access window.

5. The self-latching antenna field coupler of claim 3, wherein the antenna coupling element is positioned within the antenna chamber.

6. The self-latching antenna field coupler of claim 5, wherein the antenna chamber is substantially enclosed by the first and second housing members.

7. The self-latching antenna field coupler of claim 1, wherein the latch actuator comprises a portion of the first housing member.

8. The self-latching antenna field coupler of claim 1, further comprising a spring-loaded locking member that engages the latch actuator when the first housing member is in the second position.

9. A self-latching antenna field coupler for coupling wireless radio frequency signals emitted by an antenna received therein, comprising:

a first housing member;

a second housing member being pivotable, relative to the first housing member, between an open position to define an antenna receiving channel, and a closed position to define a substantially enclosed antenna chamber, the first and second housing members being coupled to electrical ground to form an electrical ground plane, the second housing member being biased toward an open position;

an antenna coupling element positioned within the substantially enclosed antenna chamber to passively couple the wireless radio frequency signals; and a latch actuator mechanically coupled to the second housing member, and automatically effecting movement of the second housing member from the open position to the closed position when the antenna is received in the antenna receiving channel.

10. The self-latching antenna field coupler of claim 9 wherein the latch actuator comprises a portion of the second housing member.

11. The self-latching antenna field coupler of claim 9, further comprising a spring-loaded locking member that engages the latch actuator when the second housing member is in the closed position.

12. The self-latching antenna field coupler of claim 9 wherein the first and second housing members are rotatably coupled.

13. An adapter for housing a radio communication device having an attached antenna, the adapter comprising:

an antenna field coupler, comprising:

a first housing member;

a second housing member being movable, relative to the first housing member, between an open position to define an antenna receiving channel, and a closed position to define a substantially enclosed antenna chamber, the first and second housing members being coupled to electrical ground to form an electrical ground plane;

an antenna pickup element positioned within the substantially enclosed antenna chamber;

a latch actuator mechanically coupled to the second housing member; and a spring-loaded locking member that engages the latch actuator when the second housing member is in the closed position;

wherein the latch actuator is engaged by the attached antenna to automatically cause movement of the second housing member from the open position to the closed position when the attached antenna is placed in the antenna receiving channel, such that the attached antenna is secured within the substantially enclosed antenna chamber adjacent to the antenna pickup element.

14. The adapter of claim 13, wherein the latch actuator comprises a portion of the second housing member.

15. The adapter of claim 14, wherein the latch actuator has a catch formed therein, and the spring-loaded locking member engages the catch when the second housing member is in the closed position.

16. The adapter of claim 15, wherein the spring-loaded locking member comprises a release member to disengage the spring-loaded locking member from the catch.

17. The adapter of claim 13, wherein the first and second housing members encompass the antenna when the antenna is in the substantially enclosed antenna chamber and the second housing member is in the closed position.

18. The adapter of claim 13, further comprising:

an adapter housing having a radio pocket for receiving a radio;

wherein the antenna field coupler forms part of an anchor that secures the radio within the radio pocket, when the radio is inserted into the radio pocket.

19. An apparatus, comprising:

a radio communication device having a first antenna;

a second antenna external to the radio communication device;

a vehicular adapter having the radio communication device housed therein, the vehicular adapter having a passive antenna field coupler to receive the first antenna, and to couple the first antenna to the second antenna, the passive antenna field coupler comprising:

a first housing member;

a second housing member being pivotable, relative to the first housing member, between an open position to define an antenna receiving channel, and a closed position to define a substantially enclosed antenna chamber, the first and second housing members being coupled to electrical ground to form an electrical ground plane;

an antenna pickup element positioned within the substantially enclosed antenna chamber;

a latch actuator formed on the second housing member; and a spring-loaded locking member that engages the latch actuator when the second housing member is in the closed position;

wherein the latch actuator is engaged by the first antenna to automatically cause movement of the second housing member from the open position to the closed position when the first antenna is placed in the antenna receiving channel, such that the first antenna is secured within the substantially enclosed antenna chamber adjacent to the antenna pickup element.

* * * * *